US008240655B2

(12) United States Patent
Samoto et al.

(10) Patent No.: US 8,240,655 B2
(45) Date of Patent: Aug. 14, 2012

(54) IMAGE RECORDING APPARATUS HAVING PIVOTABLE ROLLER ARM

(75) Inventors: Kenji Samoto, Nagoya (JP); Yuji Koga, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 36 days.

(21) Appl. No.: 12/892,400

(22) Filed: Sep. 28, 2010

(65) Prior Publication Data

US 2011/0156338 A1 Jun. 30, 2011

(30) Foreign Application Priority Data

Dec. 29, 2009 (JP) ..... 2009-299254

(51) Int. Cl.
*B65H 29/00* (2006.01)

(52) U.S. Cl. .... 271/3.19; 271/4.04; 271/4.1; 271/10.13; 271/225; 347/104

(58) Field of Classification Search ..... 271/3.19, 271/4.04, 4.1, 10.11, 10.13, 225, 273, 274; 399/374, 401; 347/104
See application file for complete search history.

(56) References Cited

U.S. PATENT DOCUMENTS

| | | | | |
|---|---|---|---|---|
| 5,953,575 | A * | 9/1999 | Park et al. | 399/401 |
| 6,909,872 | B2 * | 6/2005 | Eskey | 399/401 |
| 7,258,335 | B2 * | 8/2007 | Johnson et al. | 271/10.01 |
| 7,717,423 | B2 * | 5/2010 | Litman et al. | 271/273 |
| 8,152,161 | B2 * | 4/2012 | Samoto et al. | 271/186 |
| 2001/0017439 | A1 * | 8/2001 | Hiramatsu | 271/10.11 |
| 2009/0087239 | A1 | 4/2009 | Uchino et al. | |
| 2010/0278575 | A1 * | 11/2010 | Mizuno et al. | 399/401 |
| 2011/0291347 | A1 * | 12/2011 | Sano et al. | 271/3.19 |
| 2011/0310206 | A1 * | 12/2011 | Samoto et al. | 347/104 |
| 2011/0311294 | A1 * | 12/2011 | Kawamata et al. | 400/611 |

FOREIGN PATENT DOCUMENTS

| | | |
|---|---|---|
| JP | 2002-362766 | 12/2002 |
| JP | 2009-1412 | 1/2009 |

* cited by examiner

*Primary Examiner* — Jeremy R Severson

(74) *Attorney, Agent, or Firm* — Scully, Scott, Murphy & Presser, PC

(57) ABSTRACT

An image recording apparatus includes a recording unit configured to record an image on a sheet, a tray on which the sheet is placed, a first roller configured to feed the sheet placed on the tray, a first guide member configured to guide the sheet fed from the first roller to the recording unit, a second guide member configured to guide the sheet passed through the recording unit, a second roller configured to feed the sheet guided by the second guide member, a third guide member configured to guide the sheet fed from the second roller to the recording unit, a common roller configured to transmit a rotation force to the first roller and the second roller, and a second-roller arm including the second roller at a distal end thereof and configured to be pivotable about an axis.

17 Claims, 8 Drawing Sheets

IMAGE RECORDING APPARATUS HAVING PIVOTABLE ROLLER ARM

CROSS REFERENCE TO RELATED APPLICATION

The present application claims priority from Japanese Patent Application No. 2009-299254, which was filed on Dec. 29, 2009, the disclosure of which is incorporated herein by reference in its entirety.

BACKGROUND

1. Field of the Invention

The present invention relates to an image recording apparatus that records an image on a sheet, and more particularly, to an image recording apparatus capable of feeding a sheet having an image recorded to a recording unit again.

2. Description of the Related Art

An image recording apparatus capable of feeding a sheet having the image recorded to a recording unit again is known. The sheet is fed from a tray to the recording unit by a first drive mechanism. The sheet having the image recorded is fed to the recording unit by a second drive mechanism independent from the first drive mechanism, and then an image is recorded on the sheet again.

SUMMARY

Since the image recording apparatus has a configuration in which the first drive mechanism is independent from the second drive mechanism, the drive mechanism is complicated and the apparatus becomes larger in size.

A need has arisen to provide an image recording apparatus having a space-saving and also capable of feeding the sheet having the image recorded by using the drive mechanism of the tray.

According to an embodiment of the present invention, an image recording apparatus includes a recording unit configured to record an image on a sheet, a tray on which the sheet is placed, a first roller configured to feed the sheet placed on the tray, a first guide member configured to guide the sheet fed from the first roller to the recording unit, a second guide member configured to guide the sheet passed through the recording unit, a second roller configured to feed the sheet guided by the second guide member, a third guide member configured to guide the sheet fed from the second roller to the recording unit, a common roller configured to transmit a rotation force to the first roller and the second roller, and a second-roller arm including the second roller at a distal end thereof and configured to be pivotable about an axis.

DESCRIPTION OF THE PREFERRED EMBODIMENTS

Figure 1:
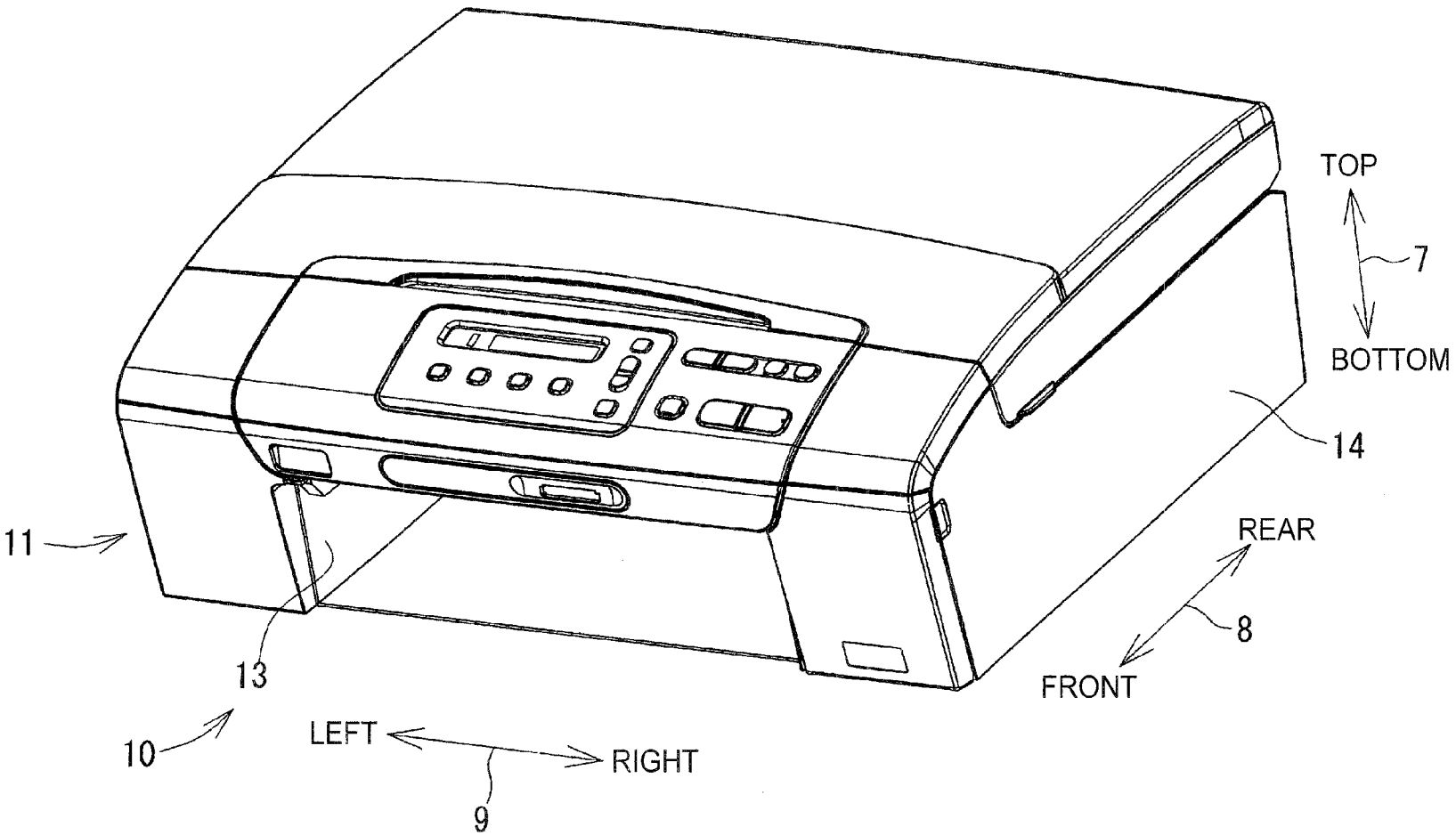
FIG. 1 is a perspective view of a multifunction apparatus according to an embodiment of the present invention.

An embodiment of the present invention will be described with appropriate reference to the drawings. The following embodiment is just exemplary, and can be appropriately modified within the scope of the invention. In the following description, an up-down direction 7 is defined with reference to a use state of a multifunction apparatus 10 (state illustrated in FIG. 1), a front-rear direction 8 is defined so that a side where an aperture 13 is provided is a front side, and a right-left direction 9 is defined with reference to a front view of the multifunction apparatus 10.

Referring to FIG. 1, the multifunction apparatus 10 is an example of an image recording apparatus. The multifunction apparatus 10 is substantially shaped like a thin rectangular parallelepiped, and a printer section 11 of an inkjet recording type is provided in a lower part thereof. The multifunction apparatus 10 has various functions such as a facsimile function and a print function. As the print function, the multifunction apparatus 10 has a duplex image recording function for recording images on both surfaces of a recording sheet. The multifunction apparatus 10 can arbitrarily have functions other than the print function. The printer section 11 includes a casing 14 having an aperture 13 on the front side. Through the aperture 13, a sheet cassette 78 (see FIG. 2) having a tray 20 (an example of a tray) on which recording sheets (an example of a sheet) of various sizes are stacked can be inserted and removed in the front-rear direction 8.

[Configuration of Printer Section 11]

Figure 2:
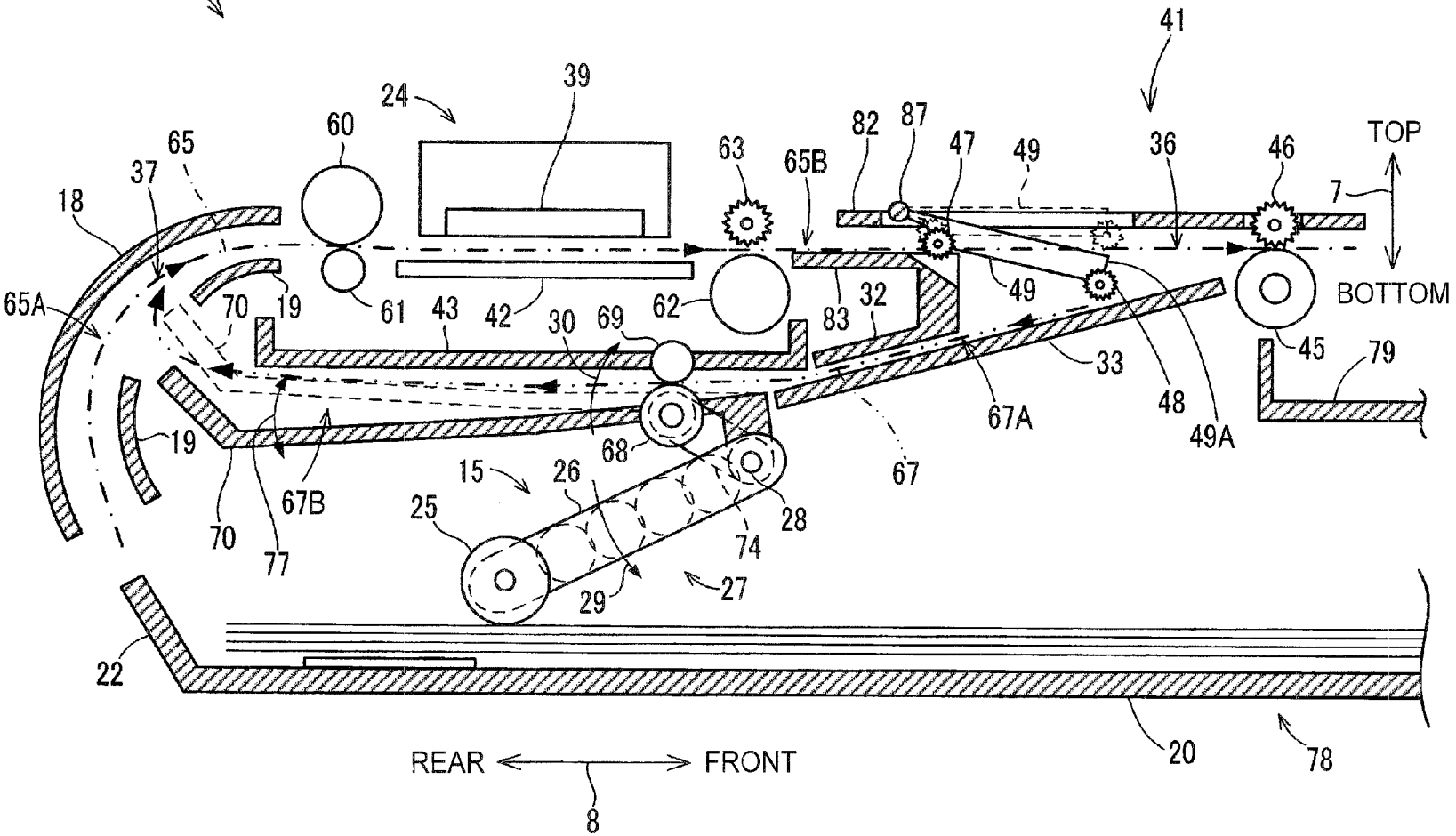
FIG. 2 is a longitudinal cross-sectional view schematically illustrating an internal structure of a printer section.

Referring to FIG. 2, the printer section 11 includes a sheet feeding unit 15 for picking up and feeding a recording sheet from the sheet cassette 78, a recording unit 24 (an example of a recording unit) of an inkjet recording type, which is provided above the tray 20, for recording an image on a recording sheet fed by the sheet feeding unit 15 by discharging ink droplets onto the recording sheet, and a path switching unit 41. The recording unit 24 is not limited to the inkjet recording type, and may be applied to various recording types such as an electrophotographic recording type.

[Conveying Path 65]

In the printer section 11, a conveying path 65 extends from a rear end of the tray 20 to the output-sheet holding portion 79. The conveying path 65 is divided into a curved path 65A provided between the rear end of the tray 20 and the recording unit 24, and an output path 65B provided between the recording unit 24 and the output-sheet holding portion 79.

The curved path 65A extends from a portion near an upper end of an inclined separating plate 22 provided in the tray 20 to the recording unit 24, and is substantially shaped like an arc centered on an inner portion of the printer section 11. A recording sheet fed from the tray 20 is guided to the recording unit 24 through the curved path 65A. The curved path 65A is defined by an outer guide member 18 and an inner guide member 19 facing with a predetermined gap being therebetween. That is, the outer guide member 18 and the inner guide member 19 serve as an example of a first guide member. The outer guide member 18 and the inner guide member 19, and an upper guide member 82, a lower guide member 83, an upper inclined guide member 32 and a lower inclined guide member 33, which will be described below, extend in a direction perpendicular to the plane of FIG. 2 (in the right-left direction 9 in FIG. 1).

The output path 65B extends straight from a portion on the downstream side of the recording unit 24 in a first conveying direction to the output-sheet holding portion 79. Here, the first conveying direction refers to a direction in which the recording sheet is conveyed through the conveying path 65 (a direction shown by a one-dot chain line with arrows in FIG. 2). The output path 65B is defined by the upper guide member 82 and the lower guide member 83 opposing with a predetermined gap being therebetween.

A branch port 36 is provided on the downstream side of the recording unit 24 in the first conveying direction. During duplex image recording, the recording sheet conveyed in the output path 65B is switched back on the downstream side of the branch port 36, and is then conveyed toward a reverse conveying path 67 described below.

[Recording Unit 24]

The recording unit 24 is provided above the sheet cassette 78, and reciprocates in the right-left direction 9 of FIG. 2. Below the recording unit 24, a platen 42 for horizontally holding a recording sheet is provided. During a reciprocating process in the right-left direction 9, the recording unit 24 discharges ink, which is supplied from an ink cartridge (not shown), from nozzles 39 onto the recording sheet conveyed on the platen 42, so that an image is recorded on the recording sheet.

A first conveying roller 60 and a pinch roller 61 are provided between the recording unit 24 and front ends of the outer guide member 18 and the inner guide member 19. The pinch roller 61 is provided under the first conveying roller 60, and is pressed against a roller surface of the first conveying roller 60 by an elastic member (not shown) such as a spring. The first conveying roller 60 and the pinch roller 61 nip the recording sheet that has been conveyed through the curved path 65A, and convey the recording sheet onto the platen 42. A second conveying roller 62 and a spur roller 63 are provided between the recording unit 24 and rear ends of the upper guide member 82 and the lower guide member 83. The spur roller 63 is pressed against a roller surface of the second conveying roller 62. The second conveying roller 62 and the spur roller 63 nip a recording sheet on which an image has been recorded by the recording unit 24, and convey the recording sheet downstream in the first conveying direction.

The first conveying roller 60 and the second conveying roller 62 are rotated by rotational driving force transmitted from a conveying motor (not shown) via a driving transmission mechanism (not shown). The driving transmission mechanism includes a planetary gear and so on, and rotates the first conveying roller 60 and the second conveying roller 62 in one direction so as to convey the recording sheet in a first conveying direction in whichever of the forward and reverse rotating directions the conveying motor is rotated. The first conveying roller 60 and the second conveying roller 62 are intermittently driven during image recording, so that an image is recorded on the recording sheet that is being fed by a predetermined line feed width.

[Sheet Feeding Unit 15]

The sheet feeding unit 15 is provided above the sheet cassette 78 and below the recording unit 24. The sheet feeding unit 15 is intended for conveyance of recording paper stacked on the tray 20 toward the curved path 65A and includes a feed roller 25 (an example of a first roller), a feed arm 26 (an example of a first-roller arm), and a transmission mechanism 27 (an example of a transmission mechanism).

When the feed roller 25 rotates, a piece of recording paper on the tray 20 is picked up and is fed into the curved path 65A. The feed roller 25 is rotatably supported by the tip of the feed arm 26. The feed roller 25 is driven by an auto-sheet-feed (ASF) motor (an example of a drive power source, not shown) with the transmission mechanism 27 interposed therebetween. The ASF motor is a drive power source separate from the conveyance motor. The transmission mechanism 27 is a transmission mechanism separate from the transmission mechanism for the conveyance motor. When a rotational force is transmitted from the ASF motor through the transmission mechanism 27 to the feed roller 25, the feed roller 25 rotates. The ASF motor is rotatable in two directions: a normal direction and a reverse direction.

Figure 3A:
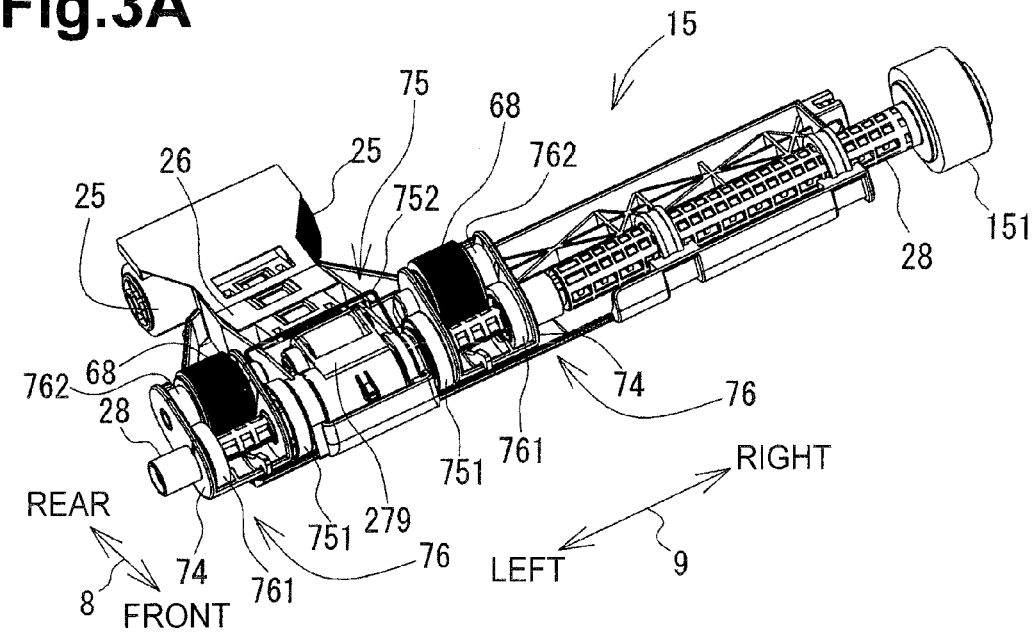
FIG. 3A is a perspective view of arms and rollers including a feed arm.
Figure 3B:
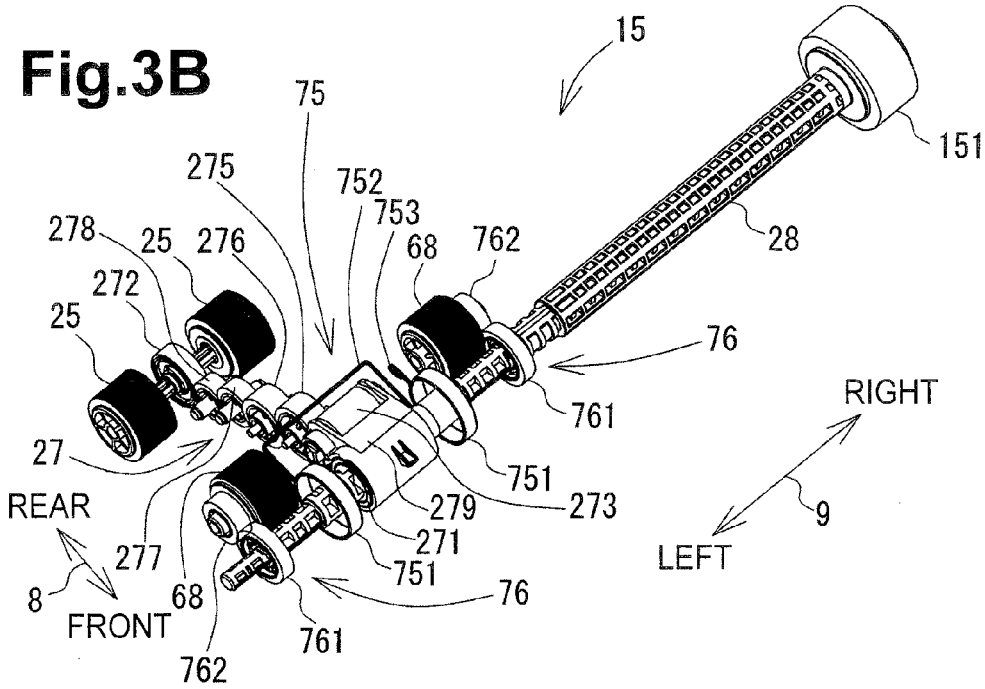
FIG. 3B is another perspective view of the arms and the rollers without the feed arm.

The sheet feeding unit 15 includes a shaft 28 (an example of a common roller, an axis). Referring to FIGS. 3A and 3B, the shaft 28 extends in the lateral direction 9 and is rotatably supported by, for example, a frame forming the casing 14 of the multifunction apparatus 10. A driving gear 151 is provided at one end of the shaft 28 and is configured to rotate together with the shaft 28. The driving gear 151 is connected to and is driven by the ASF motor. When a driving force is transmitted from the ASF motor to the driving gear 151, the driving gear 151 and the shaft 28 rotates.

Referring to FIG. 3A, the feed arm 26 is supported by the shaft 28 at the base thereof with some play with respect to the shaft 28. The feed arm 26 extends from the shaft 28 to the feed roller 25 obliquely rearward and downward. The feed arm 26 is turnable about the shaft 28.

Referring to FIG. 2, the feed arm 26 is urged with an elastic force of a coil spring 75 (an example of an urging member, see FIGS. 3A and 3B), described below, in such a manner as to turn in the direction of an arrow 29 shown in FIG. 2. The urging causes the feed roller 25 to be pressed against the top of the stack of recording paper on the tray 20. Specifically, the feed arm 26 in a state where the feed roller 25 is pressed against the top of the stack of recording paper is in a near position (corresponding to a first position) in which the tip thereof resides near the tray 20.

The feed roller 25 and the feed arm 26 are configured to be pushed upward by the top surface (the inclined separating plate 22, for example) of the sheet cassette 78 when the sheet cassette 78 is inserted into and removed from the printer section 11. The feed arm 26 that has been pushed upward by, for example, the inclined separating plate 22 is in an away position (corresponding to a second position) in which the tip thereof is away from the tray 20. Thus, the feed arm 26 is turnable between the near position and the away position.

Referring to FIG. 3A, the feed arm 26 functions as a casing that houses the shaft 28, a train of gears 271 to 278 included in the transmission mechanism 27 described below, and so forth. Referring to FIG. 3B, the transmission mechanism 27 includes a plurality (eight in the present embodiment) of gears arranged substantially in a straight line. The eight gears include a start-side gear 271 provided on the other end of the shaft 28 (the end of the shaft 28 opposite the end having the driving gear 151) in such a manner as to be rotatable together with the shaft 28, an end-side gear 272 (an example of a first row of gears) having an axis of rotation common to the axis of rotation of the feed roller 25 and configured to rotate together with the feed roller 25, and first to sixth intermediate gears 273 to 278 provided between the start-side gear 271 and the end-side gear 272. The second to sixth intermediate gears 274 to 278 (an example of a first row of gears) are rotatably supported by the feed arm 26. The first intermediate gear 273 is rotatably supported by a turnable member 279 described below. Adjoining ones of the gears 271 to 278 mesh with each other. Although six intermediate gears are provided in the present embodiment, the number of intermediate gears is not limited to six.

Figure 5A:
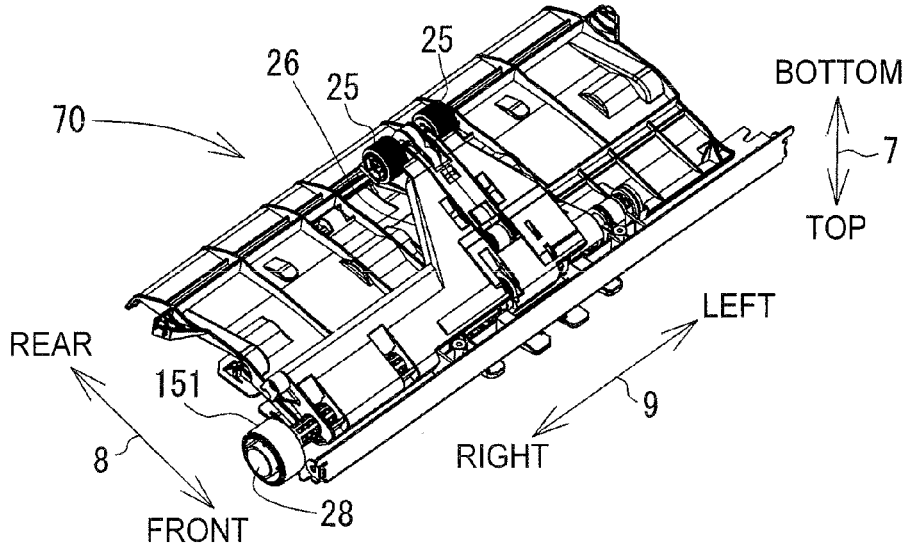
FIG. 5A is a perspective view of a turn guide member seen from obliquely below.

The feed arm 26 is positioned near the center of the tray 20 in the lateral direction 9. Referring to FIG. 5A, the feed arm 26 in the present embodiment houses only the right half of the shaft 28 extending in the lateral direction 9 in the multifunction apparatus 10.

The start-side gear 271 and the first intermediate gear 273 (an example of a second row of gears, see FIG. 3B) in combination function as a clutch. An exemplary configuration of the start-side gear 271 and the first intermediate gear 273 functioning as a clutch will now be described with reference to FIGS. 4A and 4B. The turnable member 279 is turnable about the shaft 28 in a direction in which the shaft 28 rotates. The turnable range of the turnable member 279 is restricted by a restricting member provided in a path along which the turnable member 279 turns.

Figure 4A:
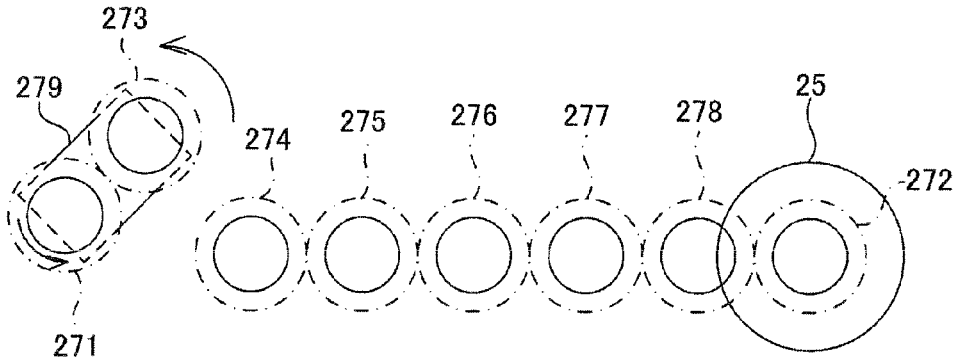
FIG. 4A is a schematic cross-sectional view of a transmission mechanism in a state where a start-side gear rotates counterclockwise.
Figure 4B:
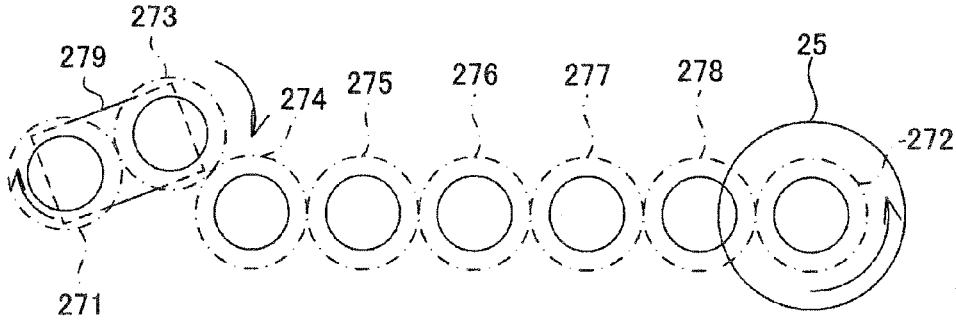
FIG. 4B is another schematic cross-sectional view of the transmission mechanism in a state where the start-side gear rotates clockwise.

Referring to FIG. 4A, when the shaft 28 and the start-side gear 271 rotate counterclockwise (in the reverse direction), the turnable member 279 turns counterclockwise, releasing the meshing between the first intermediate gear 273 supported by the turnable member 279 and the second intermediate gear 274. Therefore, the feed roller 25 does not rotate. In contrast, referring to FIG. 4B, when the shaft 28 and the start-side gear 271 rotate clockwise (in the normal direction), the turnable member 279 turns clockwise, causing the intermediate gears 273 and 274 to mesh with each other. Therefore, the feed roller 25 rotates. The direction of rotation of the feed roller 25 in the case where the shaft 28 rotates clockwise is set to be the direction in which the recording paper on the tray 20 is conveyed to the curved path 65A. The setting is made by, for example, determining the number of intermediate gears to an odd or even number. Thus, the transmission mechanism 27 is configured such that the driving force of the ASF motor is transmitted to the feed roller 25 but only the driving force produced by the normal rotation of the ASF motor is transmitted to the feed roller 25.

[Path Switching Unit 41]

As shown in FIG. 2, the path switching unit 41 is provided near the branch port 36 in the conveying path 65. The path switching unit 41 includes a third conveying roller 45 (an example of a switchback roller), a spur roller 46, and a flap 49 (an example of a flap).

The third conveying roller 45 is provided on the downstream side of the lower guide member 83, and is rotatably supported by a frame of the printer section 11 as an example. The spur roller 46 is provided on the third conveying roller 45, and is pressed against a roller surface of the third conveying roller 45 by an elastic member (not shown) such as a spring. The third conveying roller 45 is rotated in a forward or reverse direction by the driving force in the forward or reverse rotation transmitted from the conveying motor. For example, for one-sided recording, the third conveying roller 45 is rotated only in the forward direction, so that the recording sheet is conveyed downstream while being nipped between the third conveying roller 45 and the spur roller 46 and is output to the output-sheet holding portion 79. In contrast, for duplex recording, the rotating direction of the third conveying roller 45 is switched from the forward direction to the reverse direction while the third conveying roller 45 and the spur roller 46 are nipping the rear end of the recording sheet.

A support shaft 87 is provided, for example, on the frame of the printer section 11, and extends in the direction perpendicular to the plane of FIG. 2 (right-left direction 9 in FIG. 1). The flap 49 extends substantially downstream from the support shaft 87, and is rotatably supported by the support shaft 87. The flap 49 rotatably supports an auxiliary roller 47 and an auxiliary roller 48. Since roller surfaces of the auxiliary rollers 47 and 48 are to be in contact with the recording surface of the recording sheet, the auxiliary rollers 47 and 48 are shaped like spurs, similarly to the spur rollers 63 and 46.

The flap 49 can change its position, and turns between an output position higher than the lower guide member 83 (position shown by a broken line in FIG. 2) and a reversing position where an extending end portion 49A thereof is placed below the branch port 36 (position shown by a solid line in FIG. 2). After passing through the recording unit 24, the recording sheet is conveyed downstream in the first conveying direction when the flap 49 is in the output position, and is switched back into the reverse conveying path 67 when the flap 49 in the reversing position.

[Reverse Conveying Path 67]

The reverse conveying path 67 branches from the output path 65B at the branch port 36, extends below the recording unit 24 and above the driving transmission mechanism 27, and joins the curved path 65A at a joint portion 37 on the upstream side of the recording unit 24 in the first conveying direction. The recording sheet is conveyed through the reverse conveying path 67 in a second conveying direction. Here, the second conveying direction refers to a direction shown by a two-dot chain line with arrows in FIG. 2. As described above, the reverse conveying path 67 guides, to the curved path 65A, a recording sheet having at least one surface on which an image is recorded.

The reverse conveying path 67 is divided into a first path 67A and a second path 67B. The first path 67A is defined by an upper inclined guide member 32 and a lower inclined guide member 33 having inclined surfaces inclined from the branch port 36 to the lower rear side. The upper inclined guide member 32 and the lower inclined guide member 33 face each other with a predetermined gap therebetween in a manner such that the recording sheet can pass therebetween.

The second path 67B extends rearward in a substantially downward curve from a portion near a terminal end of the first path 67A, and is curved upward to a portion immediately before the joint portion 37. The second path 67B is defined by a turn guide member 70 (an example of a turn guide member) supported to turn in a direction of arrow 77 in FIG. 2, and a support member 43 attached to, for example, the frame of the printer section 11.

The upper and lower inclined guide members 32 and 33, the turn guide member 70, and the support member 43 are provided below the recording unit 24 and above the feed arm 26. Thus, the upper guide member 82, the lower guide member 83, the upper inclined guide member 32 and the lower inclined guide member 33 in combination form the second guide member. The turn guide member 70 and the support member 43 in combination form the third guide member.

Although the reverse conveying path 67 in the present embodiment is sectioned into the first path 67A and the second path 67B with which the position of the reverse conveying path 67 is changeable, the reverse conveying path 67 may alternatively be configured as a single fixed path whose position is not changeable.

[Turn Guide Member 70]

Figure 5B:
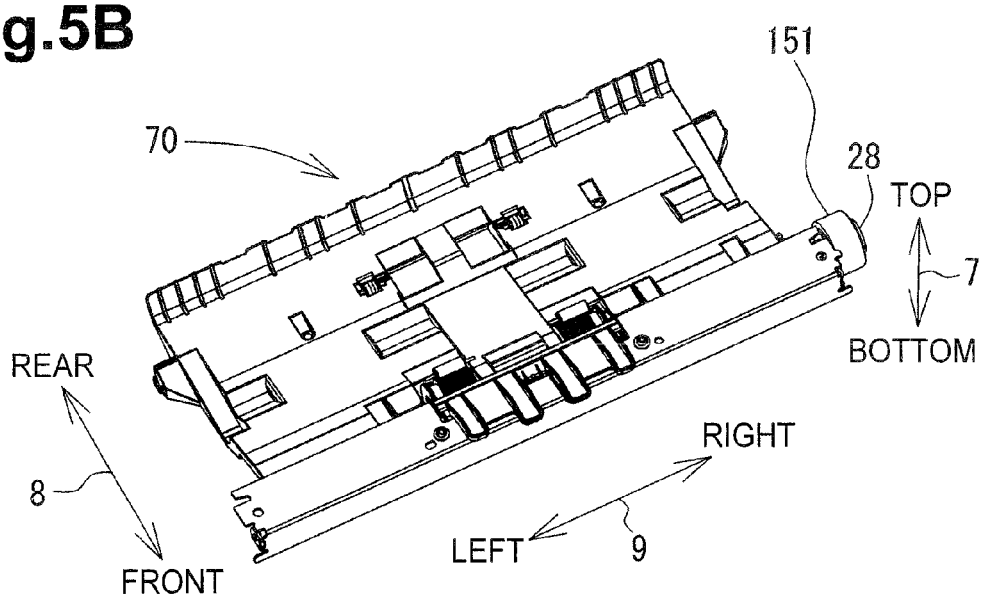
FIG. 5B is another perspective view of the turn guide member seen from obliquely above.
Figure 6A:
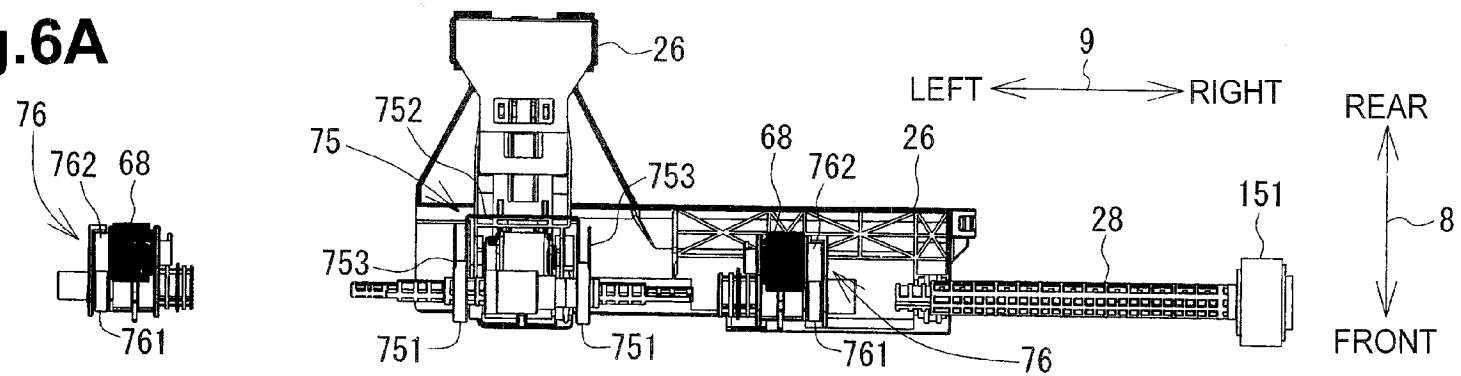
FIG. 6A is an exploded top view of the arms and the rollers.
Figure 6B:
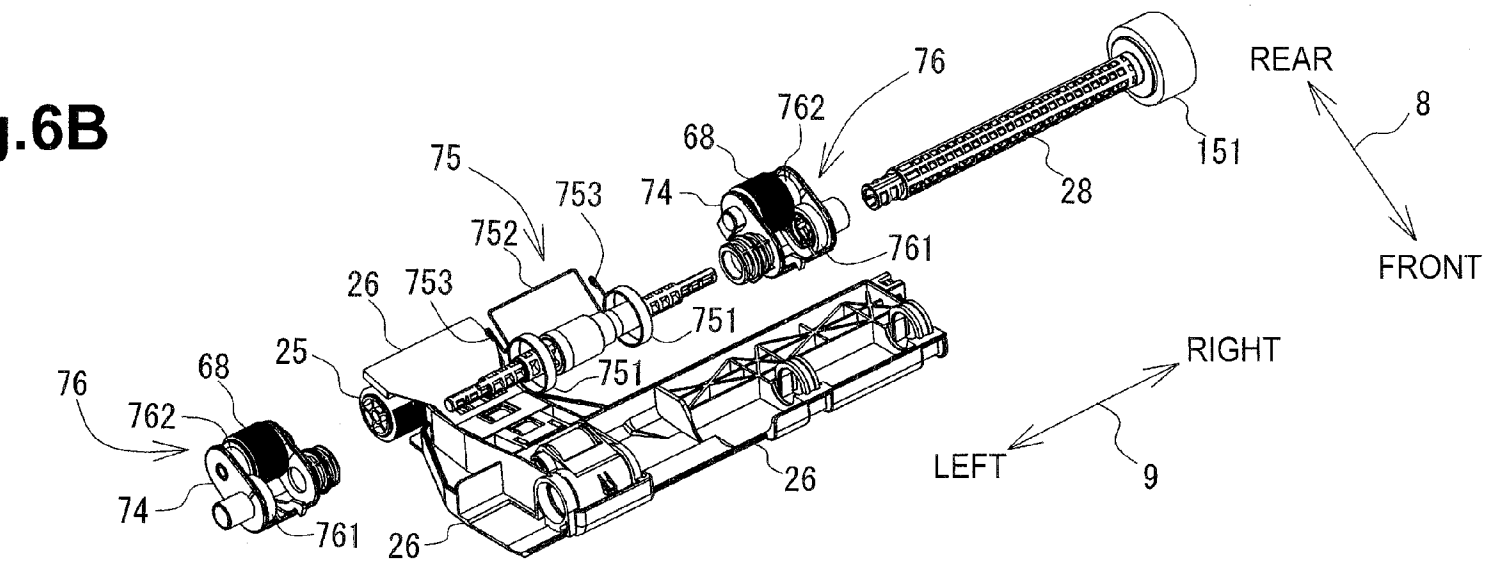
FIG. 6B is an exploded perspective view of the arms and the rollers.

Referring to FIGS. 2, 5A, and 5B, the turn guide member 70 has a generally thin flat rectangular shape with the dimension thereof in the vertical direction 7 being shorter than the dimensions thereof in the anteroposterior direction 8 and in the lateral direction 9. The base (the front-side end) of the turn guide member 70 is supported by the shaft 28 and is turnable about the shaft 28. The turn guide member 70 is turnable between a position (shown by solid lines in FIG. 2) in which the turn guide member 70 forms at least a part of the reverse conveying path 67 and a position (shown by broken lines in FIG. 2) in which the turn guide member 70 resides nearer to the recording unit 24 than in the forgoing position. For example, when the turn guide member 70 is supported by the top surface of the tray 20, the turn guide member 70 is in the position shown by the solid lines in FIG. 2. When the turn guide member 70 is pushed upward by the top surface of the feed arm 26 that is turned to the away position, the turn guide member 70 turns toward the recording unit 24.

[Fourth Conveying Rollers 68]

Referring to FIGS. 2, 3A, 3B, 6A, and 6B, fourth conveying rollers 68 (an example of a second roller) and driven rollers 69 (an example of a nipping member) are provided on the reverse conveying path 67. The driven rollers 69 are provided below the recording unit 24 and above the fourth conveying rollers 68. In the present embodiment, the driven rollers 69 are supported by the support member 43 and face the fourth conveying rollers 68, respectively. The surfaces of the fourth conveying rollers 68 are pressed against the respective driven rollers 69 by the coil spring 75 described below.

The fourth conveying rollers 68 are positioned below and face the respective driven rollers 69 on the reverse conveying path 67. When the ASF motor rotates in the reverse direction, the fourth conveying rollers 68 rotate in such a direction that the recording paper is conveyed in the second conveyance direction. In contrast, when the ASF motor rotates in the normal direction, the fourth conveying rollers 68 rotate in a direction opposite to the direction in which the recording paper is conveyed in the second conveyance direction. Thus, when the ASF motor rotates in the reverse direction, the fourth conveying rollers 68 nip the recording paper in combination with the driven rollers 69, whereby the recording paper that has been conveyed to the reverse conveying path 67 is conveyed into the curved path 65A.

Although the present embodiment concerns the case where the fourth conveying rollers 68 are pressed against the driven rollers 69, the driven rollers 69 against which the fourth conveying rollers 68 are pressed may be substituted by rubber rollers, leaf springs, spur rollers, resin rollers, or the like, as long as the recording paper can be conveyed in the second conveyance direction with the rotation of the fourth conveying rollers 68.

[Conveyance Arms 74]

Two conveyance arms 74 (an example of a second-roller arm) are supported by the shaft 28 at the bases (the front-side ends) thereof with some play with respect to the shaft 28 and are turnable about the shaft 28. That is, in the present embodiment, the axis of turning of the conveyance arms 74 coincides with the axis of turning of the feed arm 26. The conveyance arms 74 and the feed arm 26 may alternatively have different axes of turning. The fourth conveying rollers 68 are rotatably supported by the tips (the rear-side ends) of the conveyance arms 74, respectively. The conveyance arms 74 are positioned below the reverse conveying path 67 in the vertical direction 7. The two conveyance arms 74 are provided on both sides, respectively, of the feed arm 26 (see FIGS. 3A and 3B) in the lateral direction 9, i.e., in a direction (corresponding to a first direction) orthogonal to the conveyance direction along the r reverse conveying path 67.

Figure 7:
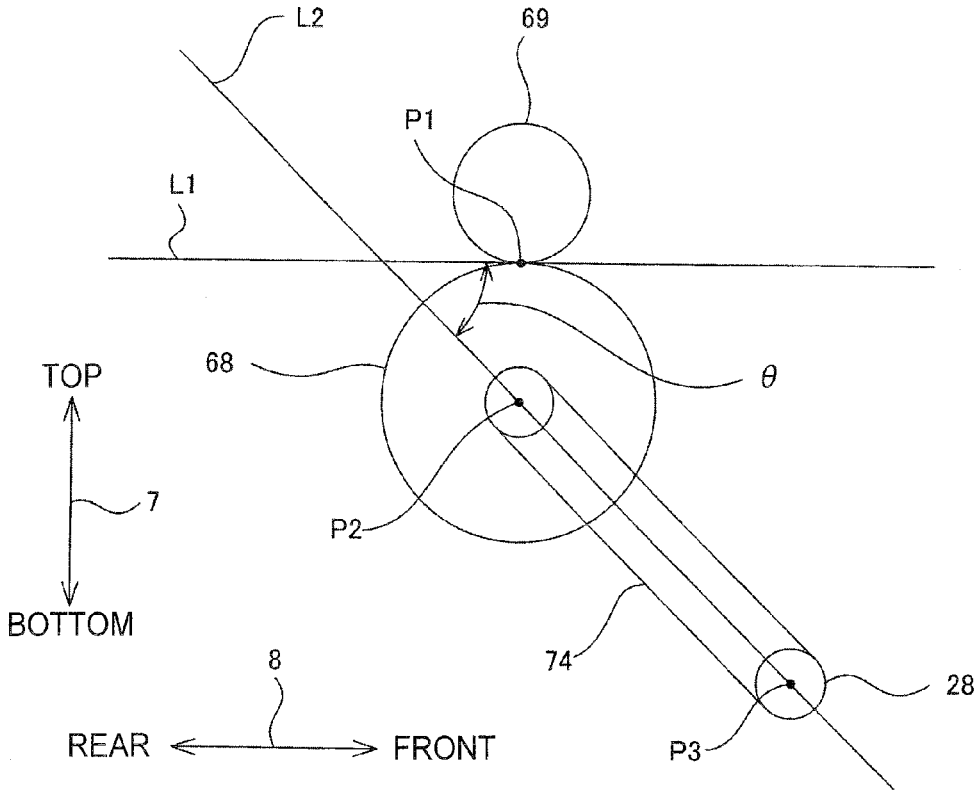
FIG. 7 is a cross-sectional view of a fourth conveying roller and a driven roller.

The conveyance arms 74 each extend from the shaft 28 to a corresponding one of the fourth conveying rollers 68 obliquely rearward and upward. Specifically, referring to FIG. 7, an angle θ formed between a first straight line L1 and a second straight line L2 is 5 degrees or larger and 45 degrees or smaller. The first straight line L1 corresponds to the conveyance direction at a point P1 where the fourth conveying roller 68 and the driven roller 69 are in contact with each other. That is, a tangent between the fourth conveying roller 68 and the driven roller 69 at the point P1. The second straight line L2 is a line connecting a center of rotation P2 of the fourth conveying roller 68 and a center of turning P3 of the conveyance arm 74.

Referring to FIGS. 2, 3A, and 3B, the length from the center of turning of the conveyance arm 74 to the center of rotation of the fourth conveying roller 68 is shorter than the length from the center of turning of the feed arm 26 to the center of rotation of the feed roller 25. The ratio of the length from the center of turning of the conveyance arm 74 to the center of rotation of the fourth conveying roller 68 to the length from the center of turning of the feed arm 26 to the center of rotation of the feed roller 25 is set to be 1 to 5. Accordingly, the ratio of the pressing force of the fourth conveying roller 68 applied to the driven roller 69 to the pressing force of the feed roller 25 applied to the stack of recording paper on the tray 20 is 5 to 1. That is, the pressing force of the fourth conveying roller 68 applied to the recording paper is larger than the pressing force of the feed roller 25 applied to the stack of recording paper. Thus, the fourth conveying roller 68 and the feed roller 25 are capable of conveying the recording paper with conveyance forces suitable for the respective conveyance paths. The length from the center of turning of the conveyance arm 74 to the center of rotation of the fourth conveying roller 68 may alternatively be longer than or equal to the length from the center of turning of the feed arm 26 to the center of rotation of the feed roller 25.

The conveyance arms 74 are urged by the elastic force of the coil spring 75, described below, in such a manner as to turn in the direction of an arrow 30 shown in FIG. 2. The urging causes the fourth conveying rollers 68 to be pressed against the driven rollers 69 as described above. Thus, the conveyance arms 74 are in a conveyance position in which the fourth conveying rollers 68 are in contact with the driven rollers 69. When the conveyance arms 74 turn downward, the conveyance arms 74 are in a downward position in which the fourth conveying rollers 68 are away from the driven rollers 69. The downward position will be described separately below.

The conveyance arms 74 each function as a casing that houses a train of gears included in a transmission mechanism 76 described below. Referring to FIGS. 3A and 3B, the transmission mechanism 76 includes a plurality (two in the present embodiment) of gears arranged in the longitudinal direction (a direction from the base to the tip) of the conveyance arm 74. The two gears include a base-side gear 761 and a tip-side gear 762 meshing with the base-side gear 761. The base-side gear 761 is provided on the other end of the shaft 28 (the end of the shaft 28 opposite the end having the driving gear 151) in such a manner as to be rotatable together with the shaft 28. The tip-side gear 762 has an axis of rotation common to the axis of rotation of the fourth conveying roller 68 and is configured to rotate together with the fourth conveying roller 68. The two gears 761 and 762 are rotatably supported by the conveyance arm 74. Although the transmission mechanism 76 includes two gears in the present embodiment, the number of gears is not limited to two.

When the shaft 28 and the base-side gear 761 rotate in response to the normal or reverse rotation of the ASF motor transmitted thereto, the tip-side gear 762 meshing with the base-side gear 761 rotates, and the fourth conveying roller 68 configured to rotate together with the tip-side gear 762 also rotates in the normal or reverse direction. The direction of rotation of the fourth conveying roller 68 in the case where the ASF motor rotates in the reverse direction is set to be the direction in which the recording paper that has been conveyed from the path switching 41 into the reverse conveying path 67 is conveyed into the curved path 65A. The setting is made by, for example, determining the number of gears included in the transmission mechanism 76 to an odd or even number. The transmission mechanism 76 may alternatively include planetary gears or the like so that only the reverse rotation of the ASF motor is transmitted to the fourth conveying roller 68.

Thus, the transmission mechanism 76 is configured to be capable of transmitting the driving force of the ASF motor to the fourth conveying roller 68, whereby the driving force produced by the normal or reverse rotation of the ASF motor is transmitted to the fourth conveying roller 68. The fourth conveying roller 68 that has received the driving force produced by the reverse rotation of the ASF motor conveys the recording paper that has been conveyed to the reverse conveying path 67 into the curved path 65A. While the ASF motor is rotating in the reverse direction, the feed roller 25 does not rotate. Although the ASF motor functions as the drive power source of the feed arm 26 and the fourth conveying roller 68 in the present embodiment, the feed arm 26 and the fourth conveying roller 68 may alternatively be driven by different motors.

[Coil Spring 75]

In the present embodiment, a double torsion spring is employed as the coil spring 75. Referring to FIGS. 3A, 3B, 6A, and 6B, the coil spring 75 includes a pair of coil portions 751, a first arm 752, and second arms 753. The pair of coil portions 751 are attached to the shaft 28. That is, the shaft 28, which functions as the common axis of turning of the feed arm 26 and the conveyance arms 74, functions as a guide shaft for the pair of coil portions 751. The first arm 752 is provided between the pair of coil portions 751 in the lateral direction 9 in a substantially rectangular U shape and connects the pair of coil portions 751 to each other. The first arm 752 is convex substantially rearward. The second arms 753 are provided at two positions and each extend substantially rearward from the outer side, in the lateral direction 9, of a corresponding one of the coil portions 751.

In a state where the coil spring 75 is attached to no component, the first arm 752 and the second arms 753 form a specific angle therebetween. In the present embodiment, the coil spring 75 is attached to the shaft 28 such that the angle formed between the first arm 752 and the second arms 753 becomes smaller than the specific angle. Thus, a force that tends to restore the foregoing angle to the specific angle acts on the first arm 752 and the second arms 753. That is, the first arm 752 and the second arms 753 receive urging forces acting in opposite directions.

The first arm 752 is in contact with the feed arm 26. The second arms 753 are attached to the conveyance arms 74, respectively, by press-fitting or the like. Therefore, the feed arm 26 that is in contact with the first arm 752 and the conveyance arms 74 that are attached to the second arms 753 are urged in opposite directions. Specifically, the feed arm 26 is urged in the direction of the arrow 29 shown in FIG. 2, and the conveyance arms 74 are urged in the direction of the arrow 30 shown in FIG. 2, opposite to the direction of the arrow 29. The coil spring 75 is not limited to a single double torsion spring and may include two torsion springs. Instead of the torsion springs, compression springs or extension springs may be employed with one-side ends thereof being attached to the feed arm 26 and the conveyance arm 74, respectively, and the other-side ends thereof being attached on, for example, the frame of the printer section 11.

When the feed arm 26 is turned further downward from the away position (see FIG. 2) and the angle formed between the first arm 752 and the second arms 753 of the coil spring 75 becomes larger than the specific angle, the conveyance arms 74 turn downward following the movement of the feed arm 26. Thus, the conveyance arms 74 turn to the downward position in which the fourth conveying rollers 68 are away from the driven rollers 69. The conveyance arms 74 receiving the urging force of the coil spring 75 press the fourth conveying rollers 68 against the driven rollers 69. Therefore, when the conveyance arms 74 are turned downward against the urging force of the coil spring 75, the conveyance arms 74 turn to the downward position, whereby the fourth conveying rollers 68 are moved away from the driven rollers 69. Thus, the conveyance arms 74 are turnable between the conveyance position and the downward position.

[Advantageous Effects of the Embodiment]

In the above embodiment, when the recording paper nipped between the fourth conveying rollers 68 and the driven rollers 69 is conveyed along the curved path 65A by the conveyance arms 74 and the fourth conveying rollers 68 with the rotation of the fourth conveying rollers 68, the fourth conveying rollers 68 receive a particularly large conveyance resistance from the recording paper. The rotational force acting on the fourth conveying rollers 68 when the fourth conveying rollers 68 receive a conveyance resistance acts as a force that turns the conveyance arms 74 in such a direction that the fourth conveying rollers 68 move toward the driven rollers 69. Thus, the pressing force of the fourth conveying rollers 68 applied to the recording paper increases, and the force with which the recording paper is nipped between the fourth conveying rollers 68 and the driven rollers 69 increases. Subsequently, the rotational force acting on the fourth conveying rollers 68 acts as a recording-paper conveyance force, whereby the recording paper is conveyed. Since the force with which the recording paper is nipped between the fourth conveying rollers 68 and the driven rollers 69 is large, the conveyance force acting on the recording paper is also large. That is, when the conveyance arms 74 and the fourth conveying rollers 68 configured as described in the above embodiment receive a conveyance resistance, the conveyance arms 74 and the fourth conveying rollers 68 increase the pressing force applied to the recording paper by themselves, thereby increasing the recording-paper conveyance force. Therefore, the fourth conveying rollers 68 and the driven rollers 69 can produce a conveyance force sufficient for conveying the recording paper even if the curvature of the path extending from the reverse conveying path 67 through the curved path 65A to the recording unit 24 is large. Thus, stable conveyance of the recording paper by the fourth conveying rollers 68 is realized.

Since the conveyance arms 74 and the fourth conveying rollers 68 increase the recording-paper conveyance force by themselves, the pressing force applied to the recording paper yet to be subjected to the conveyance resistance may be small. If the pressing force of the fourth conveying rollers 68 applied to the recording paper is small, there is no need to provide highly stiff support members or complicated support mechanisms for supporting the conveyance arms 74. Consequently, the size of the multifunction apparatus 10 can be reduced.

In the above embodiment, arm members each including the conveyance arm 74 and the fourth conveying roller 68 are provided separately from an arm member including the feed arm 26 and the feed roller 25. Therefore, the fourth conveying rollers 68 on the reverse conveying path 67 can be provided at any positions. Furthermore, since the feed arm 26 and the conveyance arms 74 have a common axis of turning, the number of shafts to be provided in the multifunction apparatus 10 can be reduced.

In the above embodiment, the coil spring 75 enables the conveyance arms 74 to stably apply a specific pressing force to the driven rollers 69 and likewise the feed arm 26 to stably apply a specific pressing force to the top of the stack of recording paper on the tray 20. Since the coil spring 75 is a double torsion spring, urging forces can be produced so as to act on both of the arms 26 and 74 with a single coil spring 75.

In a case where the feed arm 26 is provided in the center in the lateral direction 9 and a single conveyance arm 74 is provided at a position other than the center, the recording paper conveyed by the fourth conveying roller 68 receives the conveyance force only on a side thereof with respect to the center on which the fourth conveying roller 68 is provided. Therefore, the recording paper may be conveyed obliquely on the reverse conveying path 67. In contrast, in the above embodiment, since two conveyance arms 74 are provided on both sides, respectively, of the feed arm 26, the occurrence of oblique conveyance is suppressed.

In a case where two arms having rollers at the tips, respectively, thereof and configured to press a sheet with the rollers when turned are urged by a single urging member, when the length from the center of turning of each of the arms to the center of rotation of a corresponding one of the rollers becomes shorter, the pressing force to be produced becomes larger. In the above embodiment, if the pressing force applied to the recording paper by the feed roller 25 that conveys the recording paper on the tray 20 is large, double feeding of the recording paper often occurs. Therefore, the pressing force of the feed roller 25 applied to the recording paper is desired to be small. The turn guide member 70 is provided between the recording unit 24 and the feed arm 26. Therefore, the radius of curvature of the conveyance path in which the recording paper that has been conveyed along the reverse conveying path 67 is conveyed through the curved path 65A is smaller than the radius of curvature of the conveyance path in which the recording paper that has been fed from the tray 20 is conveyed through the curved path 65A. Accordingly, the conveyance resistance acting on the recording paper that is being conveyed is larger when conveyed from the reverse conveying path 67 into the curved path 65A than when conveyed from the tray 20 into the curved path 65A. That is, the conveyance force required for the fourth conveying rollers 68 is larger than the conveyance force required for the feed roller 25. Accordingly, the pressing force of the fourth conveying rollers 68 applied to the recording paper is desired to be large. In the above embodiment, the pressing force of the fourth conveying rollers 68 applied to the recording paper is larger than the pressing force of the feed roller 25 applied to the recording paper. Therefore, the recording paper can be conveyed with conveyance forces suitable for the different conveyance paths.

If the angle formed between the first straight line L1 and the second straight line L2 defined in the above embodiment is too small, the rotational force acting on the fourth conveying rollers 68 when the fourth conveying rollers 68 receive a conveyance resistance does not act as a force that turns the conveyance arms 74 but acts as a conveyance force acting on the recording paper. If such a conveyance force acting on the recording paper is not larger than the conveyance resistance, the fourth conveying rollers 68 may slip on the recording paper, and the recording paper may not be able to be conveyed. In contrast, if the angle formed between the first straight line L1 and the second straight line L2 is too large, the rotational force acting on the fourth conveying rollers 68 when the fourth conveying rollers 68 receive a conveyance resistance does not act as the conveyance force acting on the recording paper but only acts as a force that turns the conveyance arms 74. Consequently, the recording paper may not be able to be conveyed. To avoid this, if the angle formed between the first straight line L1 and the second straight line L2 is set to be 5 degrees or larger and 45 degrees or smaller as in the above embodiment, the pressing force of the fourth conveying rollers 68 applied to the recording paper increases first, and the recording paper is then conveyed with a large conveyance force. Therefore, by setting the angle formed between the first straight line L1 and the second straight line L2 to be 5 degrees or larger and 45 degrees or smaller, the conveyance arms 74 and the fourth conveying rollers 68 increase the pressing force applied to the recording paper by themselves when the conveyance arms 74 and the fourth conveying rollers 68 receive a conveyance resistance. Thus, the conveyance force applied to the recording paper can be increased.

When the driving force produced by the reverse rotation of the ASF motor is transmitted through the transmission mechanisms 76 to the fourth conveying rollers 68, the fourth conveying rollers 68 rotate in such a direction that the recording paper that has been conveyed to the reverse conveying path 67 is conveyed into the curved path 65A. While the recording paper is being conveyed by the fourth conveying rollers 68, the feed roller 25 configured to feed the recording paper on the tray 20 is not allowed to be driven. In the above embodiment, since the driving force produced by the reverse rotation of the ASF motor is prevented from being transmitted to the feed roller 25, a misdriving of the feed roller 25 is prevented.

[Variations of the Embodiment]

Figure 8A:
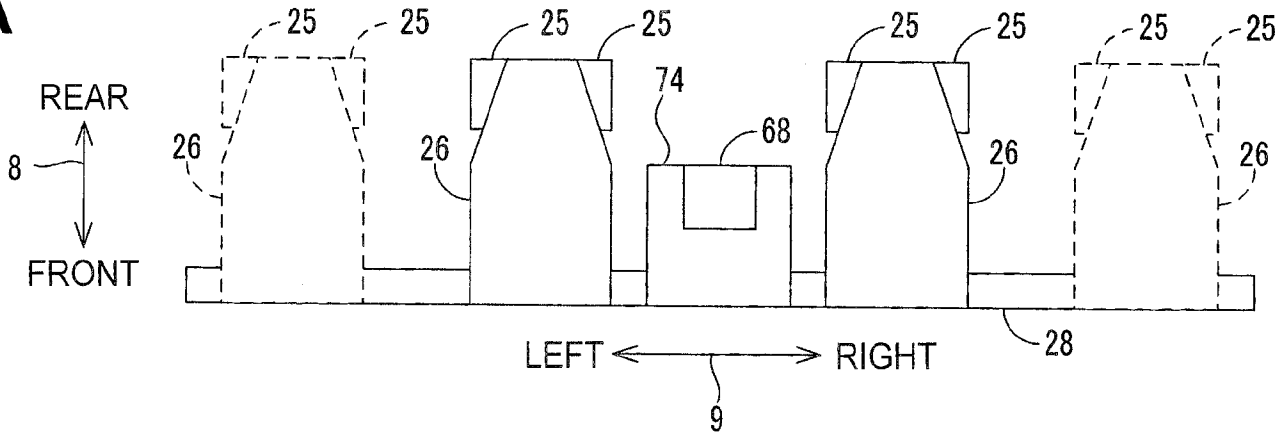
FIG. 8A is a schematic plan view of two feed arms provided on both sides of a conveyance arm.

Although the above embodiment concerns the case where two conveyance arms 74 are provided on both sides of the feed arm 26 in the lateral direction 9, the positional relationship between the conveyance arms 74 and the feed arm 26 is not limited thereto. For example, referring to FIG. 8A, two feed arms 26 may be provided on both sides of a conveyance arm 74 in the lateral direction 9. In that case, as shown by broken lines in FIG. 8A, the feed arms 26 may be provided at ends of the reverse conveying path 67 in the lateral direction 9.

Figure 8B:
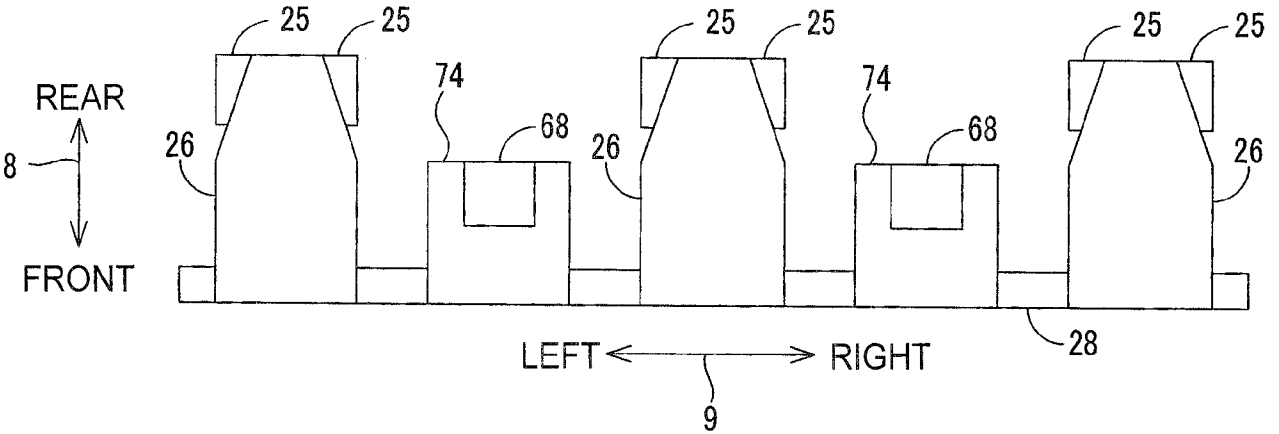
FIG. 8B is a schematic plan view of a plurality of feed arms and a plurality of conveyance arms.

Furthermore, three or more conveyance arms 74 and three or more feed arms 26 may be provided. For example, referring to FIG. 8B, three feed arms 26 may be provided in the center and at ends of the reverse conveying path 67 in the lateral direction 9, with two conveyance arms 74 interposed between the feed arm 26 in the center and the feed arms 26 at the ends. That is, at least two feed arms 26 and at least two conveyance arms 74 may be arranged in the lateral direction 9.

If a conveyance arm 74 is provided in the center in the lateral direction 9 and a feed arm 26 is provided at a position other than the center, the recording paper fed from the tray 20 by the feed roller 25 may be conveyed obliquely. In the former variation, however, since two feed arms 26 are provided on both sides of the conveyance arm 74, the occurrence of oblique conveyance is suppressed. In the latter variation in which at least two feed arms 26 and at least two conveyance arms 74 are arranged in the lateral direction 9, when the recording paper is conveyed by the feed rollers 25 or the fourth conveying rollers 68, a conveyance force is applied to the recording paper at a plurality of positions in the lateral direction 9. Therefore, the occurrence of oblique conveyance is suppressed.

What is claimed is:

1. An image recording apparatus comprising:

a recording unit configured to record an image on a sheet;

a tray on which the sheet is placed;

a first roller configured to feed the sheet placed on the tray;

a first guide member configured to guide the sheet fed from the first roller to the recording unit;

a second guide member configured to guide the sheet passed through the recording unit;

a second roller configured to feed the sheet guided by the second guide member;

a third guide member configured to guide the sheet fed from the second roller to the recording unit;

a common roller configured to transmit a rotation force to the first roller and the second roller; and a second-roller arm including the second roller at a distal end thereof and configured to be pivotable about rotating shaft of the common roller.

2. The image recording apparatus according to claim 1, further comprising a first-roller arm including the first roller at a distal end thereof and configured to be pivotable between a first position where the first roller contacts the tray and a second position where the first roller is spaced away from the tray.

3. The image recording apparatus according to claim 2, wherein the first-roller arm rotates about the rotating shaft of the common roller.

4. The image recording apparatus according to claim 2, further comprising an urging member configured to urge the second-roller arm upward.

5. The image recording apparatus according to claim 4, wherein the urging member includes a coil spring whose axis coincides with a pivot axis of one of the first-roller arm and the second-roller arm.

6. The image recording apparatus according to claim 2, further comprising an urging member configured to urge the second-roller arm such that the second roller nips the sheet and to urge the first-roller arm such that the first-roller arm pivots from the second position to the first position.

7. The image recording apparatus according to claim 2, wherein the second-roller arm includes two second-roller arms disposed on both sides, respectively, of the first-roller arm in a first direction orthogonal to a conveying direction of the sheet fed along the third guide member.

8. The image recording apparatus according to claim 2, wherein the first-roller arm includes two first-roller arms disposed on both sides, respectively, of the second-roller arm in a first direction orthogonal to a conveying direction of the sheet fed along the third guide member.

9. The image recording apparatus according to claim 2, wherein each of the first-roller arm and the second-roller arm includes at least two arms arranged in a first direction orthogonal to a conveying direction of the sheet fed along the third guide member.

10. The image recording apparatus according to claim 2, wherein a length from the rotating shaft of the common roller to a rotation axis of the second roller is shorter than a length from a pivot axis of the first-roller arm to a rotation axis of the first roller.

11. The image recording apparatus according to claim 1, further comprising a nipping member facing the second roller and configured to nip the sheet in combination with the second roller.

12. The image recording apparatus according to claim 11, wherein a conveying direction of the sheet at which the second roller and the nipping member contact and a direction connecting a rotation axis of the second roller and a rotation axis of the second-roller arm form an angle of 5 to 45 degrees.

13. The image recording apparatus according to claim 1, wherein the first roller rotates, for feeding the sheet, in a rotational direction and the second roller rotates, for feeding the sheet, in a direction opposite to the rotational direction.

14. The image recording apparatus according to claim 1, wherein the recording unit records an image on a first surface of the sheet, and the second roller contacts a second surface of the sheet opposite to the first surface.

15. The image recording apparatus according to claim 1, further comprising a switchback roller, wherein the second guide member comprises a flap configured to be pivotable, and wherein when the sheet is nipped by the switchback roller and a rear end of the sheet passes a predetermined position, the flap presses the rear end of the sheet downward by its own weight and the switchback roller rotates in reverse such that the sheet is reversed to be fed to the second roller.

16. The image recording apparatus according to claim 1, further comprising:

a drive power source rotatable in normal and reverse directions; and a transmission mechanism capable of transmitting a driving force of the drive power source to the first roller and the second roller, the transmission mechanism comprising a first row of gears and a second row of gears, wherein the second row of gears rotates with the second roller and the first row of gears rotates with the first roller, wherein when the drive power source rotates in a first direction, the second row of gears and the first row of gears mesh with each other and the drive force is transmitted to the first roller, and when the drive power source rotates in a second direction, the second row of gears and the first row of gears become out of mesh and the drive force is not transmitted to the first roller but the second roller rotates.

17. The image recording apparatus according to claim 1, wherein the third guide member comprises a turn guide member configured to be pivotable about the rotating shaft of the common roller.

* * * * *